US012320231B2

(12) United States Patent
Al-Ghamdi et al.

(10) Patent No.: US 12,320,231 B2
(45) Date of Patent: Jun. 3, 2025

(54) CEMENTING A WELLBORE

(71) Applicant: Saudi Arabian Oil Company, Dhahran (SA)

(72) Inventors: Muataz S. Al-Ghamdi, Dhahran (SA); Mohammed S. Alghamdi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 288 days.

(21) Appl. No.: 17/941,779

(22) Filed: Sep. 9, 2022

(65) Prior Publication Data

US 2024/0084668 A1 Mar. 14, 2024

(51) Int. Cl.

| | |
|---|---|
| ***E21B 33/16*** | (2006.01) |
| ***E21B 23/06*** | (2006.01) |
| ***E21B 34/14*** | (2006.01) |

(52) U.S. Cl.

CPC ..... *E21B 33/16* (2013.01); *E21B 23/06* (2013.01); *E21B 34/142* (2020.05); *E21B 2200/05* (2020.05)

(58) Field of Classification Search

CPC ..... E21B 33/16; E21B 34/142; E21B 23/06; E21B 2200/05; E21B 2200/06

See application file for complete search history.

(56) References Cited

U.S. PATENT DOCUMENTS

| | | | | |
|---|---|---|---|---|
| 3,181,614 | A * | 5/1965 | Brown | E21B 33/1295 166/134 |
| 7,353,878 | B2 | 1/2008 | Themig | |
| 2007/0095533 | A1* | 5/2007 | Rogers | E21B 33/14 166/285 |
| 2009/0211759 | A1 | 8/2009 | East, Jr. et al. | |
| 2010/0282511 | A1 | 11/2010 | Maranuk et al. | |
| 2012/0279705 | A1* | 11/2012 | Moffitt | E21B 43/10 166/285 |
| 2014/0041876 | A1* | 2/2014 | Fleckenstein | E21B 43/14 166/329 |
| 2014/0262321 | A1* | 9/2014 | Fripp | E21B 34/066 166/205 |
| 2018/0112493 | A1* | 4/2018 | Recchioni | E21B 34/10 |

* cited by examiner

*Primary Examiner* — Tara Schimpf
*Assistant Examiner* — Lamia Quaim
(74) *Attorney, Agent, or Firm* — Fish & Richardson P.C.

(57) ABSTRACT

A wellbore assembly that includes a wellbore string and a packer assembly. The wellbore string is disposed within a wellbore. The packer assembly is releasably coupled to the wellbore string. The wellbore string extends downhole of the packer assembly. The packer assembly has a housing, a flapper valve, and a packer. The housing is fluidly coupled to the wellbore string. The flapper valve moves between a closed position, in which a fluid pathway of the housing is closed by the flapper valve, and an opened position, in which the fluid pathway is opened, allowing fluid to flow across the bore of the housing. The packer is attached to the housing. The packer isolates, with the packer set on the wellbore and the flapper valve closed, a first section of the non-vertical wellbore uphole of the packer from a second section of the non-vertical wellbore downhole of the packer.

20 Claims, 4 Drawing Sheets

CEMENTING A WELLBORE

FIELD OF THE DISCLOSURE

This disclosure relates to wellbore operations, and more particularly to cementing operations.

BACKGROUND OF THE DISCLOSURE

Wellbore cementing can be used to construct, fix, isolate, or plug wellbores. Some cementing operations involve placing a cement plug in a wellbore to either abandon the wellbore, abandon depleted zones of the wellbore, seal off lost circulation zones of the wellbore, or perform a side-tracking drilling operation. The process of placing a cement plug in a wellbore can be lengthy and expensive. Methods and equipment for improving cement plug operations are sought.

SUMMARY

Implementations of the present disclosure include a wellbore assembly that includes a wellbore string and a packer assembly. The wellbore string is disposed within a non-vertical wellbore. The packer assembly is releasably coupled to the wellbore string. The wellbore string extends downhole of a downhole outlet of the packer assembly. The packer assembly has a housing, a flapper valve, and a packer. The housing has a bore fluidly coupled to the wellbore string. The flapper valve is attached to the housing and moves between a closed position, in which a fluid pathway of the housing is closed by the flapper valve, and an opened position, in which the fluid pathway is opened, allowing fluid to flow across the bore of the housing. The packer is attached to the housing. The packer isolates, with the packer set on the wellbore and the flapper valve closed, a first section of the non-vertical wellbore uphole of the packer from a second section of the non-vertical wellbore downhole of the packer.

In some implementations, the wellbore string sets, with the wellbore string attached to the packer assembly and the wellbore string propping the flapper valve opened, the packer on a wall of an open hole section of the non-vertical wellbore. The wellbore string is configured to flow, with the packer assembly set on the wall of the wellbore, cement to place a cement plug at the first section or the second section. The wellbore string is configured to be released from the packer assembly and be pulled uphole of the packer assembly to allow the flapper valve to close and prevent the cement from flowing between the first section and the second section.

In some implementations, the wellbore string includes a downhole end and the packer is configured to be set at a depth along the wellbore in which the downhole end of the wellbore string is at a bottom hole end of the non-vertical wellbore.

In some implementations, the packer assembly is drillable and the packer assembly is configured to remain set on the wall during curing of the cement.

In some implementations, the flapper valve includes a spring that biases the flapper valve to the closed position to restrict cement from flowing uphole along the fluid pathway.

In some implementations, the packer assembly is releasably coupled to the wellbore string by one or more shear pins extending from the wellbore string to the bore of the packer assembly, the shear pins break under a shear force applied, with the packer set on the wall, by the wellbore string biased uphole or downhole with respect to the packer assembly.

In some implementations, the packer is set hydraulically, electrically, or mechanically. In some implementations, the packer is set hydraulically, and the wellbore string includes a ball seat downhole of a fluid port of the wellbore string in fluid communication with the bore of the packer assembly. The ball seat receives a ball to allow pressurization of the bore and set the packer on the wall of the wellbore.

In some implementations, the flapper valve prevents the mixing of the cement with a control fluid without the use of a spacer or chemical wash and without balancing the cement plug.

In some implementations, the flapper valve is disposed at an inlet of the packer assembly, and the flapper valve is propped open in an uphole direction.

In some implementations, the wellbore assembly further includes a second packer assembly disposed, with the packer assembly releasably coupled to the wellbore string, uphole of the packer assembly. The second packer assembly is releasably coupled to the wellbore assembly. The second packer assembly includes a second housing, a second flapper valve, and a second packer. The second housing defines a second bore fluidly coupled to the wellbore string. The second flapper valve is attached to the second housing. The second flapper valve moves between a closed position, in which a second fluid pathway of the second housing is closed by the flapper valve, and an opened position, in which the second fluid pathway is opened, allowing fluid to flow across the bore of the second housing. The second packer is attached to the second housing. The second packer is set on the wall of the wellbore to define, with the packer set of the packer assembly, a middle section configured to be isolated with the flapper valve and the second flapper valve closed. The wellbore string sets, with the wellbore string propping the second flapper valve opened, the second packer. The wellbore string flows cement to place a cement plug at the middle section. The wellbore string is released from the second packer assembly and pulled uphole of the second packer assembly to allow the first flapper valve and the second flapper valve to close and prevent the cement from flowing to the second section or to a third section uphole of the second flapper valve.

Implementations of the present disclosure also include a wellbore assembly that includes a wellbore string and a packer assembly. The wellbore string is disposed within a wellbore. The packer assembly is releasably coupled to the wellbore string. The packer assembly includes a housing, a valve, and a packer. The valve is attached to the housing and moves between a closed position, in which a fluid pathway of the housing is closed, and an opened position, in which the fluid pathway is opened, allowing fluid to flow across the housing. The packer is attached to the housing and is arrange to be set on a wall of the wellbore. The wellbore string sets the packer on the wellbore and the wellbore string flows, with the packer set, cement to a first section downhole of the valve or a second section uphole of the valve. The wellbore string is released from the packer assembly to allow the valve to close and prevent the cement from flowing between the first section and the second section.

In some implementations, the wellbore string includes a downhole end that extends downhole of the packer assembly. The packer is set at a depth along the wellbore in which the downhole end of the wellbore string is at a bottom hole end of the non-vertical wellbore. In some implementations, the valve includes a flapper valve that includes a spring configured to bias the flapper valve to the closed position to restrict cement from flowing uphole along the fluid pathway.

In some implementations, the packer is set hydraulically, and the wellbore string includes a ball seat downhole of a fluid port of the wellbore string in fluid communication with the packer assembly. The ball seat receives a ball to allow pressurization of the packer assembly and set the packer on the wall of the wellbore. In some implementations, the wellbore assembly further includes a second packer assembly similar to the packer assembly. The second packer assembly is disposed, with the packer assembly coupled to the wellbore string, uphole of the packer assembly. The wellbore string sets the second packer assembly and flow cement to place a cement plug at a middle section defined between the first and second packer assembly.

Implementations of the present disclosure also include a method. The method includes setting, with a wellbore string, a packer assembly on a wall of a wellbore. The packer assembly is releasably coupled to the wellbore string. The packer assembly includes (i) a housing, (ii) a valve attached to the housing, and (iii) a packer attached to the housing. The method also includes directing, with the packer set on the wall, cement to a first section downhole of the valve or a second section uphole of the valve. The method also includes releasing the wellbore string from the packer assembly to allow the valve to close and prevent the cement from flowing between the first section and the second section, containing the cement within the first section or the second section.

In some implementations, setting the packer assembly includes setting, by applying fluidic pressure to the packer assembly with fluid flown through the wellbore string, the packer of the packer assembly. In some implementations, the wellbore string includes a ball seat and the packer assembly is fluidly coupled to the wellbore string, and setting the packer includes placing a ball on the ball seat and pressurizing the packer assembly.

In some implementations, releasing the wellbore string from the packer assembly includes retrieving the wellbore string from within the packer assembly, allowing the valve to close and contain the cement within the cement retainer.

In some implementations, directing the cement includes flowing the cement to a section of the wellbore downhole of the valve.

DETAILED DESCRIPTION OF THE DISCLOSURE

The present disclosure relates to methods and equipment for placing a cement plug in a wellbore, and more particularly for placing a cement plug without balancing the cement plug. Balancing is a technique used to place cement plugs in wellbores. The technique includes running a wellbore string to the desired depth, then pumping cement, and then a spacer to avoid mud contamination. The cement volume is carefully calculated to obtain an equal height of cement in the annulus and the wellbore string, thus balancing the cement. The length of the cement plug is determined by the volume of cement pumped and the location and dimensions of the wellbore string. Once the cement and spacer are placed, the string is slowly pulled with no rotation to avoid disturbing the balanced cement plug. Due to gravity forces, balancing a cement plug is particularly difficult in non-vertical wellbores such as highly deviated wellbores or horizontal wellbores.

The method and equipment of the present disclosure include a packer assembly that allows placing a cement plug in non-vertical wellbores without having to balance the cement plug. The packer assembly includes a housing with a flapper valve and a packer that, together with a wellbore string that extends downhole of the packer assembly, place a cement plug at a desired depth without the need to balance the cement plug.

Particular implementations of the subject matter described in this specification can be implemented so as to realize one or more of the following advantages. For example, the packer assembly of the present disclosure can help prevent backflow of cement during a plugging operation. Additionally, the cement retainer of the present disclosure can help avoid potential downhole problems such as cement failures. Moreover, the packer assembly can help reduce the number of operations required to plug a non-vertical wellbore (particularly in comparison to balancing cementing operations), which can help improve the cost efficiency of cementing operations.

Figure 1:
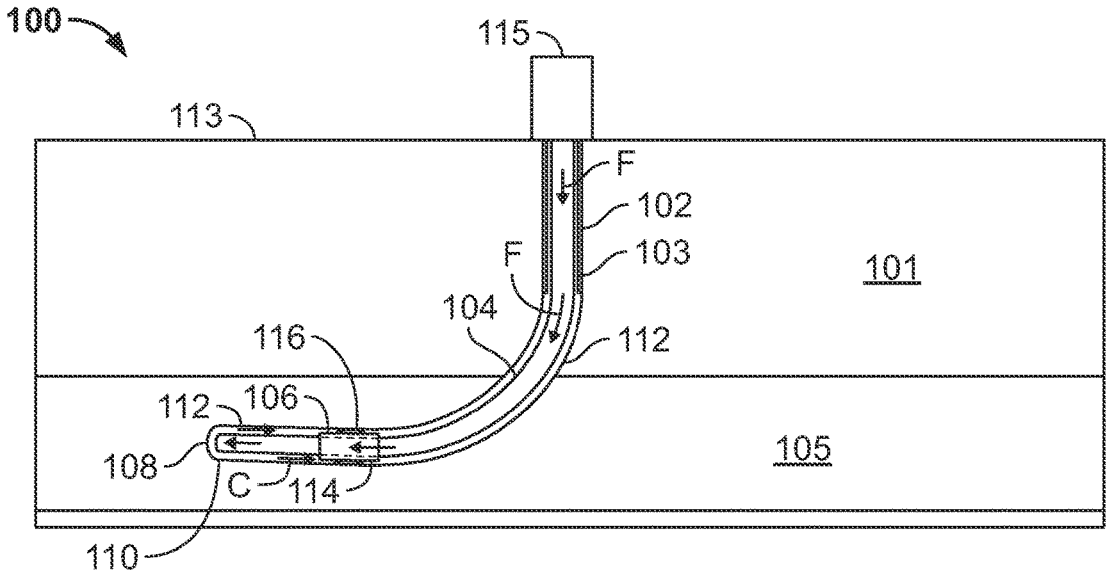
FIG. 1 is a schematic view, partially cross-sectional, of a wellbore assembly disposed within a wellbore during a plug placement operation.

FIG. 1 shows a wellbore assembly 100 disposed within a wellbore 102 (e.g., a non-vertical wellbore) formed in a geologic formation 101. The geologic formation 101 can include a hydrocarbon reservoir 105 from which hydrocarbons can be extracted. The wellbore 102 extends from a surface 113 (e.g., a terranean surface) of the wellbore 102 to a downhole end 108 of the wellbore 102. The wellbore 102 can be cased, uncased, or it can have an open hole section 112 downhole of a casing 103 or liner disposed within the wellbore 102.

The wellbore assembly 100 includes a wellbore string or tubing string 104 (e.g., a drill string) and a packer assembly 106 releasably attached to the wellbore string 104. The packer assembly 106 has a housing 114 and one or more isolation packers 116. As further described in detail below with respect to FIGS. 2-5, the wellbore string 104 lowers the packer assembly 106 within the wellbore 102 and sets the packer assembly 106 on a wall 110 of the wellbore 102 to place a cement plug downhole of the packer assembly 106. The wellbore string 104 can be attached to surface equipment 115 such as a rig or a truck or a crane that moves the wellbore string 104 along the wellbore 102. The wellbore string 104 is also fluidly coupled to a pump (not shown) such as a surface pump that flows fluid (e.g., cement slurry "C" and drilling fluid "F") downhole from the surface 113 of the wellbore 102 to place a cement plug.

Figure 2:
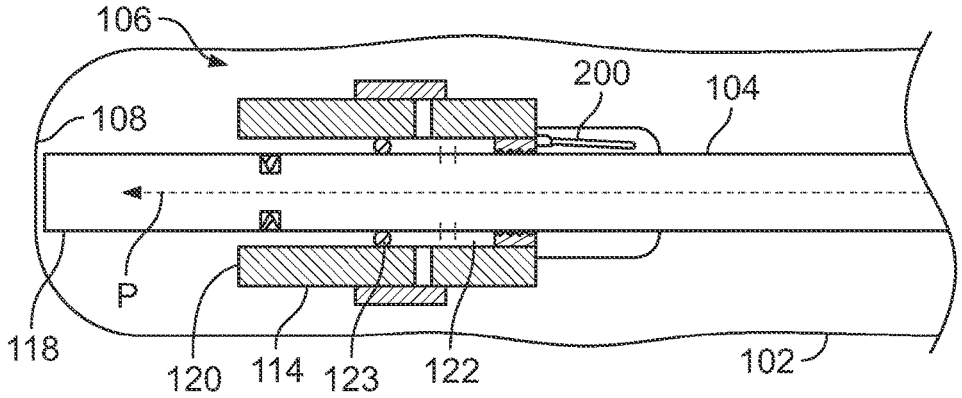
FIGS. 2-5 are front schematic views, partially cross-sectional, of sequential steps of performing a plug placement operation with a packer assembly according to a first implementation of the present disclosure.

FIGS. 2-5 are sequential steps of performing a cementing operation (e.g., a plugging operation) with the packer assembly 106 according to a first implementation of the present disclosure. As shown in FIG. 2, the packer assembly 106 is lowered with the wellbore 102 with the wellbore string 104. The packer assembly 106 can be lowered to a desired location by using sensors to determine the required location or by using the wellbore string 104 as a guide.

For example, the wellbore string 104 can extend downhole of a downhole outlet 120 of the packer assembly 106 to be used as a guide. In other words, a downhole end 118 of the wellbore string 104 can extend past the packer assembly 106 a distance corresponding to the length or the location of the cement plug. For example, the downhole end 118 can be used as a guide by serving as an indicator of the desired location of the packer assembly 106 when the downhole end 118 reaches the downhole end 108 of the wellbore. Thus, when placing the cement plug at the end 108 of a wellbore, the downhole end 118 of the wellbore string 104 extends past the packer assembly 106 a distance corresponding to the length of the cement plug.

The packer assembly 106 also includes a valve 200 (e.g., a flapper valve) attached to the housing 114. The flapper valve 200 is disposed at an inlet of the packer assembly 106 and it opens in an uphole direction. The packer assembly 106 has a bore 122 that is fluidly coupled to the wellbore string 104. The flapper valve 200 moves or pivots between a closed position, in which a fluid pathway "P" of the housing 114 is closed by the flapper valve 200 (see FIG. 5), and an opened position, in which the fluid pathway "P" is opened, allowing fluid to flow across the bore 122 of the housing 114.

The wellbore string 104 sets, with the wellbore string 104 attached to the packer assembly 106 and the wellbore string 104 propping the flapper valve 200 opened, the packer 116 on the wall 110 of the open hole section of the wellbore 102. In other words, the wellbore string 104 can be attached to the packer assembly 106 at the surface of the wellbore by inserting the packer assembly 106 within the wellbore string 104 so that the wellbore string 104 keeps the flapper valve 200 opened and the wellbore string can flow fluid to below the packer assembly 106 inside the wellbore 102.

Figure 3:
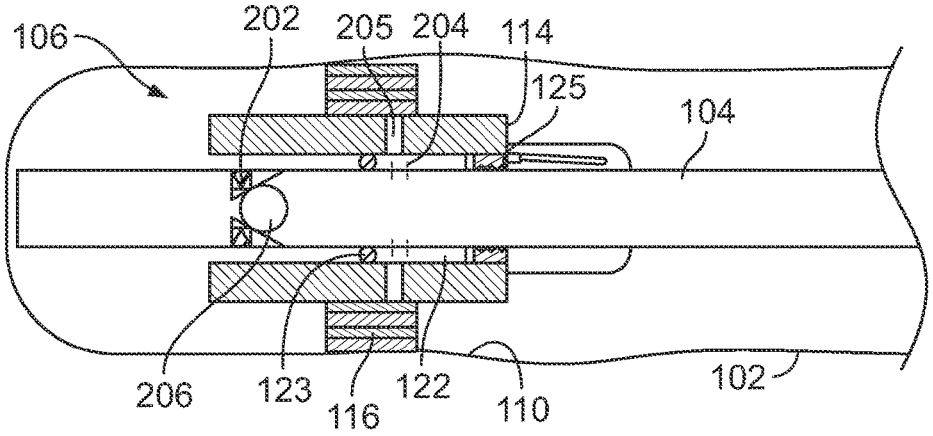

Referring to FIG. 3, the wellbore string 104 can set the packer assembly 106 on the wall 110 of the wellbore 102 mechanically, hydraulically, or electrically. For example, the wellbore string 104 can be pulled uphole (or rotated) to activate the packer, or the wellbore string 104 can be fluidly coupled to the packer assembly 106 to activate the packers 116. Specifically, as shown in FIG. 3, the packer assembly 106 can be fluidly coupled to the wellbore string 104 through fluid ports 204 to the packer assembly 106. The packer assembly 106 can have sealing elements 123, 125 (e.g., an O-ring) that prevent fluid from flowing out the packer assembly 106 and allow the packer assembly 106 to be pressurized to activate the packers 116.

To pressurize the packer assembly 106, the wellbore string has a ball seat 202 that receives a ball 206 to allow pressurization of the bore 122 and thus activate and set the packers 116 on the wall 110 of the wellbore 102. The ball seat 202 is disposed downhole of the fluid ports 204 of the wellbore string 104 to direct, with the ball 206 on the ball seat, fluid toward the bore 122 of the packer assembly 106. Once in the bore 122, the fluid flows to the activation ports 205 of the packers 116 to activate the packers 116.

After the packer assembly 106 is set on the wellbore 102, the wellbore string 104 can continue to be pressurized until the ball seat 202 is sheared off to regain circulation. In other words, the ball seat 202 is pushed downhole (and can be pushed out of the wellbore string 104) to allow cement to be pumped out of the wellbore string 104 and into the wellbore.

Figure 4:
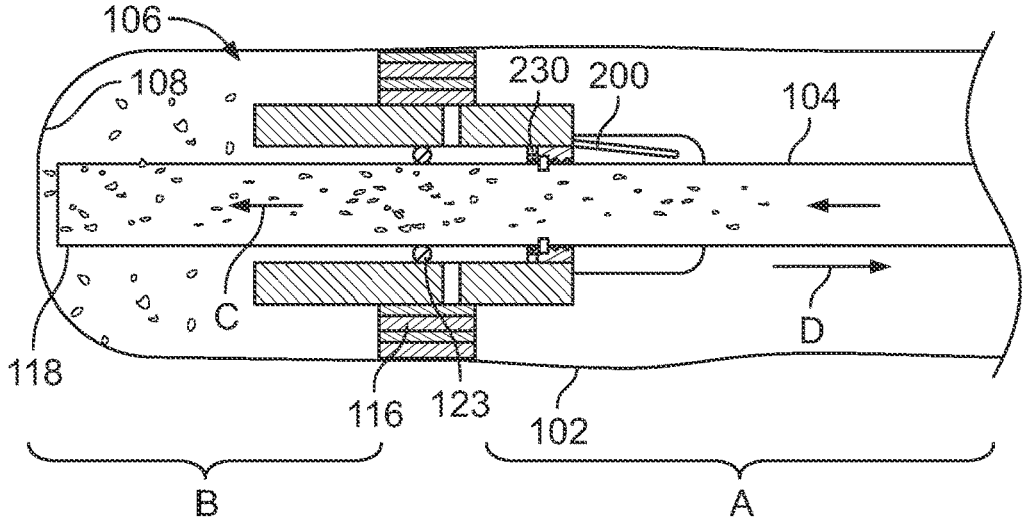

As shown in FIG. 4, the wellbore string 104 directs cement "C" downhole and out of the downhole end 118 of the wellbore string to form a plug that extends from the valve 200 and the packer 116 to the downhole end 108 of the wellbore 102. After or during pumping of the cement "C," the wellbore string is pulled uphole in a direction "D" away from the downhole end 108 of the wellbore 102.

When the packer 116 is set, the packer 116 isolates a first section "A" of the wellbore 102 uphole of the packer 116 from a second section "B" of the wellbore downhole of the packer 116. The wellbore string 104 directs cement "C" from the surface of the wellbore to the second section "B" to place a cement plug at the second section "B." After or during flowing of the cement "C," the wellbore string 104 is detached from the packer assembly. For example, the packer assembly 106 can be attached to the wellbore string 104 by shear pins 230 that extend from the bore of the packer assembly to the wellbore string. To detach the wellbore string 104 form the packer assembly 106, the wellbore string 104 is pulled or pushed from the surface of the wellbore 102 to break off the shear pins 230. In some implementations, the shear pins 230 can be broken by fluid pressure applied during or after setting the packers 116.

Figure 5:
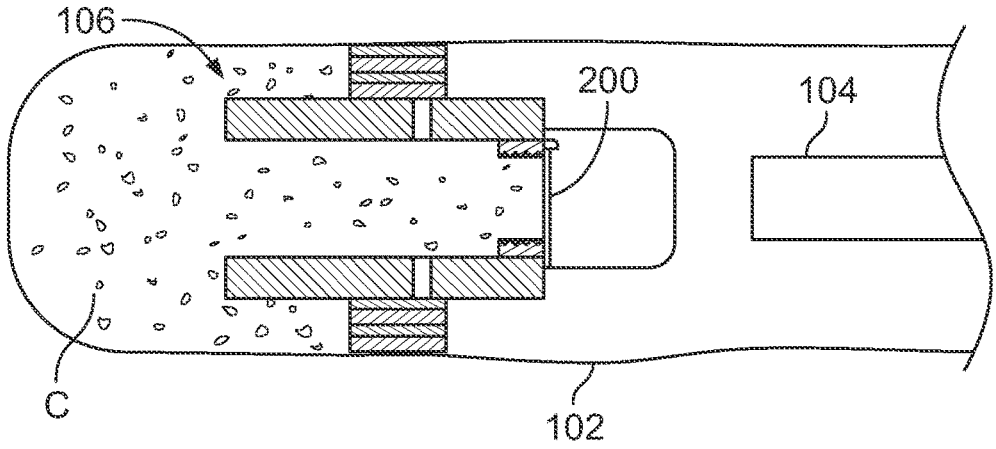

As illustrated in FIG. 5, once or while the cement "C" is flown to the desired location of the wellbore 102, the wellbore string 104 is pulled uphole to allow the valve 200 to close. For example, the flapper valve 200 can have a spring (e.g., a spring-loaded hinge) that biases the flapper valve 200 to the closed position to restrict cement "C" from flowing uphole along the fluid pathway. In other words, the valve 200 closes to prevent the cement "C" from flowing to the first section "A" (see FIG. 4) of the wellbore 102. Thus, the flapper valve 200 creates a closed system that keeps the cement "C" in place and prevents it from slumping. Excess cement volume above the packer can be circulated out of the wellbore 102. The cement "C" forms a cement plug that can be permanent or that can be drilled along with the packer assembly 106 to continue drilling downhole of the plug. In some cases, the cement is flown downhole by a control fluid that pushes the cement, and the valve 200 prevents the mixing of the cement with the control fluid without the use of a spacer or chemical wash. The cement is thus placed in a non-vertical wellbore without balancing the cement plug.

Figure 6:
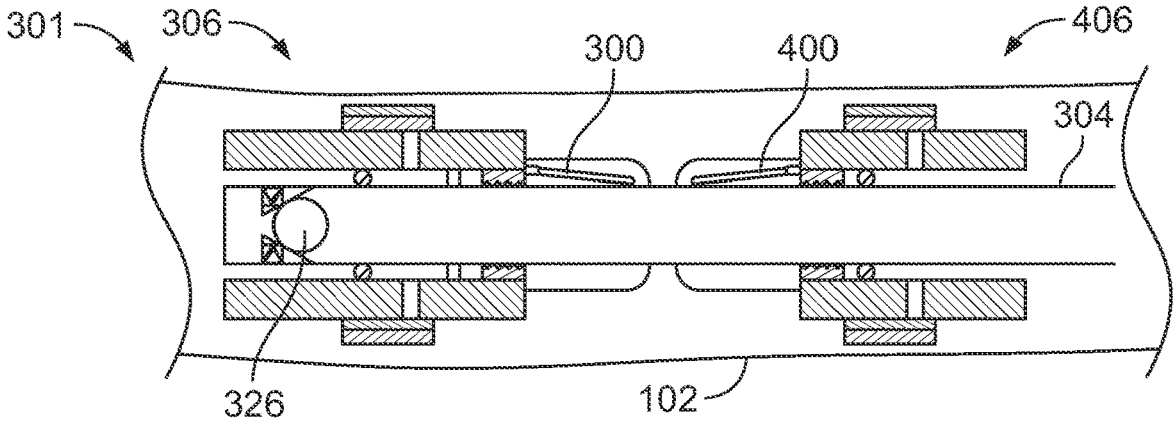
FIGS. 6-9 are front schematic views, partially cross-sectional, of sequential steps of performing a plug placement operation with a packer assembly according to a second implementation of the present disclosure.

Referring now to FIGS. 6-9, a wellbore assembly 301 according to a second configuration can be used to place a cement plug in a location other than the downhole end of the wellbore 102. As shown in FIG. 6, the wellbore assembly 301 has two packer assemblies 306, 406 releasably attached to a wellbore string 304. The wellbore string lowers the two packer assemblies along the wellbore 102 to a desired location where the cement plug is to be placed.

Each packer assembly 306, 406 is similar to the packer assembly 106 in FIGS. 2-5. The downhole packer assembly 306 faces the uphole packer assembly 406 such that their flapper valves 300, 400 open toward each other. Both packer assemblies 306, 406 have a hosing with a bore fluidly coupled to the wellbore string 304 to receive fluid and activate their packers.

Figure 7:
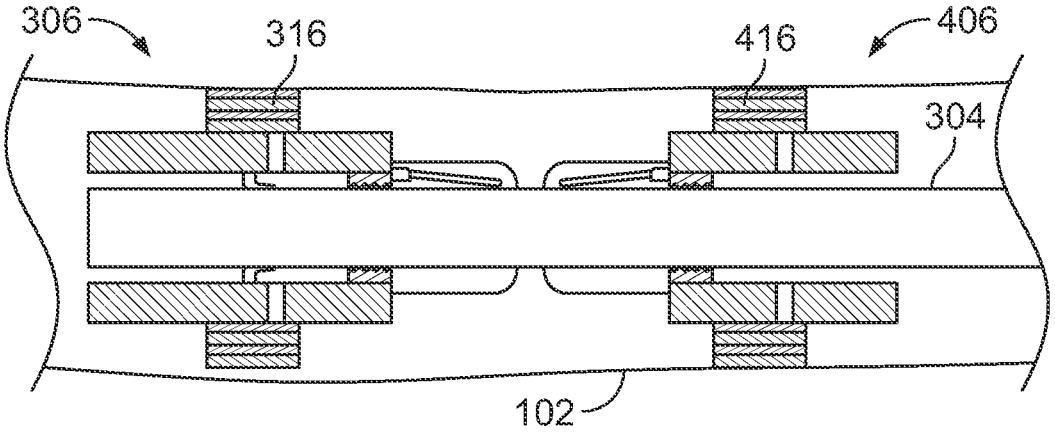

As shown in FIGS. 6 and 7, similar to the packer assembly of FIGS. 2-5, the packer assemblies 306, 406 can be activated by first dropping a ball 326 that closes circulation through the wellbore string 304, and then pressurizing the wellbore assemblies to expand their packers 316, 416. As shown in FIG. 7, the two packers 316, 416 together define, when set on the wellbore 102, a middle section that, with the valves 300, 400 closed, is isolated from the rest of the wellbore 102.

Figure 8:
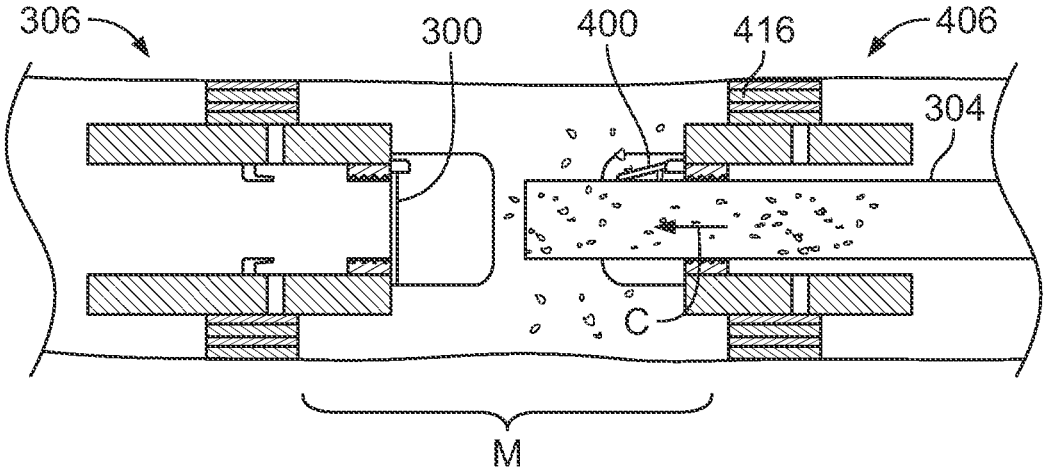

As shown in FIG. 8, the wellbore string 304 is pulled uphole to allow the first valve 300 to close and thus prevent the pumped cement "C" from flowing into the first packer assembly 306. With the wellbore string still stinging the second packer assembly 406, cement "C" is pumped to the middle section "M." defined between the two packers 316, 416 and valves 300, 400.

Figure 9:
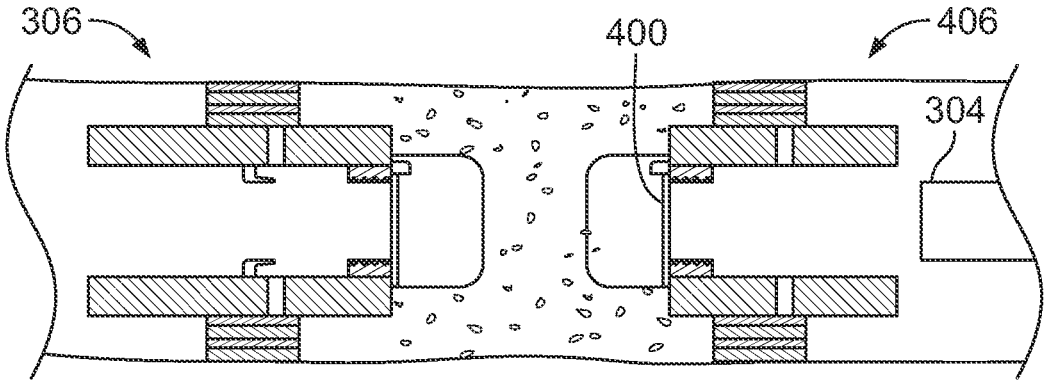

As illustrated in FIG. 9, once the cement "C" has been pumped, the wellbore string is 304 is pulled uphole from the second packer assembly 406 to allow the second valve to close and contain the cement "C."

Figure 10:
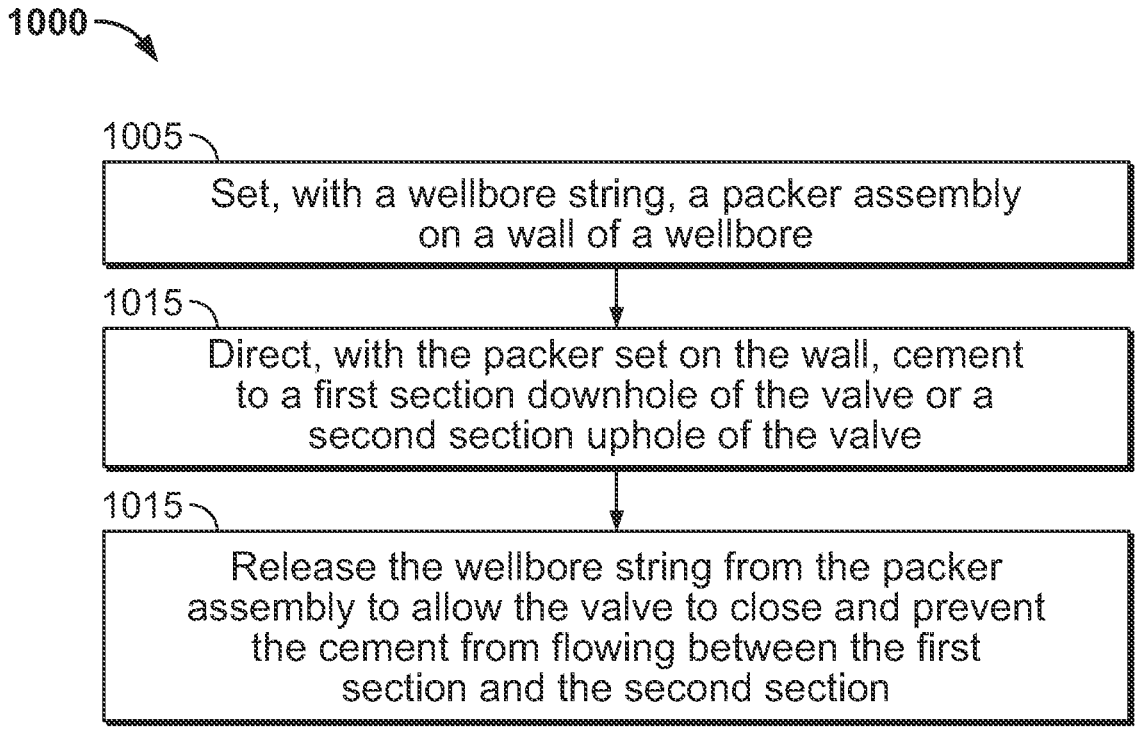
FIG. 10 is a flow chart of a plug placement method according to implementations of the present disclosure.

FIG. 10 shows a flow chart of an example method 1000 of placing a cement plug.

The method includes setting, with a wellbore string, a packer assembly on a wall of a wellbore. The packer assembly is releasably coupled to a downhole section of the wellbore string. The packer assembly has (i) a housing, (ii) a valve attached to the housing, and (iii) a packer attached to the housing (1005). The method also includes directing, with the packer set on the wall, cement to a first section downhole of the valve or a second section uphole of the valve (1010). The method also includes releasing the wellbore string from the packer assembly to allow the valve to close and prevent the cement from flowing between the first section and the second section, containing the cement within the first section or the second section (1015).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly, comprising:

a wellbore string configured to be disposed within a non-vertical wellbore;

a first packer assembly configured to be releasably coupled to the wellbore string with the wellbore string extending downhole of a downhole outlet of the first packer assembly, the first packer assembly comprising:

a first housing defining a first bore fluidly coupled to the wellbore string;

a first flapper valve attached to the first housing, the first flapper valve configured to move between a closed position, in which a first fluid pathway of the first housing is closed by the first flapper valve, and an opened position, in which the first fluid pathway is opened, allowing fluid to flow across the bore of the first housing; and a first packer attached to the first housing, the first packer configured to fluidly isolate, with the first packer set on the wellbore and the first flapper valve closed, a first section of the non-vertical wellbore uphole of the first packer from a second section of the non-vertical wellbore downhole of the first packer; and a second packer assembly disposed, with the first packer assembly releasably coupled to the wellbore string, uphole of the first packer assembly, the second packer assembly releasably coupled to the wellbore assembly, the second packer assembly comprising:

a second housing defining a second bore fluidly coupled to the wellbore string;

a second flapper valve attached to the second housing, the second flapper valve configured to move between a closed position, in which a second fluid pathway of the second housing is closed by the flapper valve, and an opened position, in which the second fluid pathway is opened, allowing fluid to flow across the bore of the second housing; and a second packer attached to the second housing, the second packer configured to be set on the wall of the wellbore to define, with the packer set of the second packer assembly, a middle section configured to be isolated with the flapper valve and the second flapper valve closed, wherein the wellbore string is configured to set, with the wellbore string attached to the first packer assembly and the wellbore string propping the first flapper valve opened, the first packer on a wall of an open hole section of the non-vertical wellbore, and the wellbore string is configured to flow, with the first packer assembly set on the wall of the wellbore, cement to place a cement plug at the first section or the second section, and the wellbore string is configured to be released from the first packer assembly and be pulled uphole of the first packer assembly to allow the first flapper valve to close and prevent the cement from flowing between the first section and the second section, and the wellbore string is configured to set, with the wellbore string propping the second flapper valve opened, the second packer, and the wellbore string is configured to flow cement to place a cement plug at the middle section, and the wellbore string is configured to be released from the second packer assembly and pulled uphole of the second packer assembly to allow the flapper valve and the second flapper valve to close and prevent the cement from flowing to the second section or to a third section uphole of the second flapper valve.

2. The wellbore assembly of claim 1, wherein the wellbore string comprises a downhole end and the first packer is configured to be set at a depth along the wellbore in which the downhole end of the wellbore string is at a bottom hole end of the non-vertical wellbore.

3. The wellbore assembly of claim 2, wherein the first packer is configured to be set hydraulically, electrically, or mechanically.

4. The wellbore assembly of claim 3, wherein the first packer is configured to be set hydraulically, and the wellbore string comprises a ball seat downhole of a fluid port of the wellbore string in fluid communication with the first bore of the first packer assembly, the ball seat configured to receive a ball to allow pressurization of the bore and set the first packer on the wall of the wellbore.

5. The wellbore assembly of claim 1, wherein the first packer assembly is drillable and the first packer assembly is configured to remain set on the wall during curing of the cement.

6. The wellbore assembly of claim 1, wherein the first flapper valve comprises a spring configured to bias the first flapper valve to the closed position to restrict cement from flowing uphole along the first fluid pathway.

7. The wellbore assembly of claim 1, wherein the first packer assembly is releasably coupled to the wellbore string by one or more shear pins extending from the wellbore string to the bore of the first packer assembly, the shear pins configured to break under a shear force applied, with the first packer set on the wall, by the wellbore string biased uphole or downhole with respect to the first packer assembly.

8. The wellbore assembly of claim 1, wherein the first packer is configured to be set hydraulically, electrically, or mechanically.

9. The wellbore assembly of claim 8, wherein the first packer is configured to be set hydraulically, and the wellbore string comprises a ball seat downhole of a fluid port of the wellbore string in fluid communication with the first bore of the first packer assembly, the ball seat configured to receive a ball to allow pressurization of the bore and set the first packer on the wall of the wellbore.

10. The wellbore assembly of claim 1, wherein the first flapper valve prevents the mixing of the cement with a control fluid without the use of a spacer or chemical wash and without balancing the cement plug.

11. The wellbore assembly of claim 1, wherein the first flapper valve is disposed at an inlet of the first packer assembly, and the first flapper valve is configured to be propped open in an uphole direction.

12. A wellbore assembly, comprising:

a wellbore string configured to be disposed within a wellbore; and a first packer assembly and a second packer assembly, each of the first packer assembly and the second packer assembly configured to be releasably coupled to the wellbore string, each of the first packer assembly and the second packer assembly comprising:

a housing;

a valve attached to the housing, the valve configured to move between a closed position, in which a fluid pathway of the housing is closed, and an opened position, in which the fluid pathway is opened, allowing fluid to flow across the housing; and a packer attached to the housing, the packer configured to be set on a wall of the wellbore;

wherein the second packer assembly is disposed, with the first packer assembly coupled to the wellbore string, uphole of the first packer assembly, the wellbore string is configured to set the packer of the first packer assembly on the wellbore and the wellbore string is configured to flow, with the packer set, cement to a first section downhole of the valve of the first packer assembly or a second section uphole of the valve of the first packer assembly, and the wellbore string is configured to be released from the first packer assembly to allow the valve of the first packer assembly to close and prevent the cement from flowing between the first section and the second section, and the wellbore string is configured to set the second packer assembly and flow cement to place a cement plug at a middle section defined between the first packer assembly and the second packer assembly.

13. The wellbore assembly of claim 12, wherein the wellbore string comprises a downhole end extending downhole of the first packer assembly, the packer of the first packer assembly configured to be set at a depth along the wellbore in which the downhole end of the wellbore string is at a bottom hole end of the wellbore.

14. The wellbore assembly of claim 12, wherein the valve of the first packer assembly comprises a flapper valve comprising a spring configured to bias the flapper valve to the closed position to restrict cement from flowing uphole along the fluid pathway.

15. The wellbore assembly of claim 12, wherein the packer of the first packer assembly is configured to be set hydraulically, and the wellbore string comprises a ball seat downhole of a fluid port of the wellbore string in fluid communication with the first packer assembly, the ball seat configured to receive a ball to allow pressurization of the first packer assembly and set the packer of the first packer assembly on the wall of the wellbore.

16. A method, comprising:

setting, with a wellbore string, a first packer assembly on a wall of a wellbore, the first packer assembly releasably coupled to the wellbore string, the first packer assembly comprising (i) a first housing, (ii) a first valve attached to the housing, and (iii) a first packer attached to the first housing;

setting, with the wellbore string, a second packer assembly on the wall of the wellbore, the second packer assembly releasably coupled to the wellbore string and disposed, with the first packer assembly coupled to the wellbore string, uphole of the first packer assembly, the second packer assembly comprising (i) a second housing, (ii) a second valve attached to the housing, and (iii) a second packer attached to the second housing;

directing, with the packer set on the wall, cement to a first section downhole of the valve or a second section uphole of the first valve; flowing cement to place a cement plug at a middle section defined between the first packer assembly and the second packer assembly; and releasing the wellbore string from the first packer assembly to allow the first valve to close and prevent the cement from flowing between the first section and the second section, containing the cement within the first section or the second section.

17. The method of claim 16, wherein setting the first packer assembly comprises setting, by applying fluidic pressure to the first packer assembly with fluid flowed through the wellbore string, the first packer of the first packer assembly.

18. The method of claim 16, wherein the wellbore string comprises a ball seat and the first packer assembly is fluidly coupled to the wellbore string, and setting the first packer comprises placing a ball on the ball seat and pressurizing the first packer assembly.

19. The method of claim 16, wherein releasing the wellbore string from the first packer assembly comprises retrieving the wellbore string from within the first packer assembly, allowing the first valve to close and contain the cement within the first packer assembly.

20. The method of claim 16, wherein directing the cement comprises flowing the cement to a section of the wellbore downhole of the first valve.

* * * * *